US008894063B2

(12) United States Patent
Araaki et al.

(10) Patent No.: US 8,894,063 B2
(45) Date of Patent: Nov. 25, 2014

(54) IMAGE FORMING APPARATUS AND SHEET POSITIONING DEVICE USING METHOD OF SHEET POSITIONING

(71) Applicants: Satoshi Araaki, Tokyo (JP); Jumpei Aoyama, Kanagawa (JP); Yosuke Eguchi, Tokyo (JP); Rie Ohtsuka, Tokyo (JP)

(72) Inventors: Satoshi Araaki, Tokyo (JP); Jumpei Aoyama, Kanagawa (JP); Yosuke Eguchi, Tokyo (JP); Rie Ohtsuka, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/855,112

(22) Filed: Apr. 2, 2013

(65) Prior Publication Data

US 2013/0270765 A1 Oct. 17, 2013

(30) Foreign Application Priority Data

Apr. 17, 2012 (JP) ..... 2012-093580
May 31, 2012 (JP) ..... 2012-124086

(51) Int. Cl.

| | |
|---|---|
| ***B65H 1/04*** | (2006.01) |
| ***B65H 1/26*** | (2006.01) |
| ***B65H 1/00*** | (2006.01) |
| ***B65H 7/02*** | (2006.01) |

(52) U.S. Cl.

CPC ..... *B65H 1/00* (2013.01); *B65H 2405/332* (2013.01); *B65H 2511/51* (2013.01); *B65H 2301/4222* (2013.01); *B65H 2403/411* (2013.01); *B65H 2513/40* (2013.01); *B65H 1/266* (2013.01); *B65H 2801/06* (2013.01); *B65H 7/02* (2013.01); *B65H 2513/512* (2013.01)

USPC ..... 271/171; 271/145

(58) Field of Classification Search

USPC ..... 271/171, 145, 241
See application file for complete search history.

(56) References Cited

U.S. PATENT DOCUMENTS

| | | | | |
|---|---|---|---|---|
| 4,874,160 | A * | 10/1989 | Yamamoto | 271/227 |
| 4,908,673 | A * | 3/1990 | Muramatsu | 399/402 |
| 7,635,129 | B2 * | 12/2009 | Inoue | 271/258.01 |
| 7,984,903 | B2 * | 7/2011 | Coret et al. | 271/171 |
| 8,256,976 | B2 * | 9/2012 | Edwards et al. | 400/642 |
| 2006/0255531 | A1 * | 11/2006 | Azzopardi et al. | 271/171 |
| 2011/0175282 | A1 | 7/2011 | Sagawa et al. | |

FOREIGN PATENT DOCUMENTS

| | | | |
|---|---|---|---|
| JP | 5-043058 | | 2/1993 |
| JP | 05170340 | A * | 7/1993 |
| JP | 07225533 | A * | 8/1995 |
| JP | 2001-171893 | | 6/2001 |
| JP | 2005-170609 | | 6/2005 |

(Continued)

*Primary Examiner* — Luis A Gonzalez
(74) *Attorney, Agent, or Firm* — Harness, Dickey & Pierce, P.L.C.

(57) ABSTRACT

An image forming apparatus to which a sheet positioning device can be provided to perform a sheet positioning includes an image forming device and a sheet positioning device that includes a sheet setting plate, a pair of side fence units disposed facing each other along opposite sides of the sheet setting plate to move in a lateral direction of the sheet, a moving mechanism to move the pair of side fence units, a contact member to contact and press the sheet, a position detector to detect the position of the contact member, and a controller moving the pair of side fence units when the sheet is placed on the sheet setting plate, halting movement of the pair of side fence units after the contact member has contacted and pressed the sheet, and moving the pair of side fence units again based on detection results obtained by the position detector.

19 Claims, 8 Drawing Sheets

(56) References Cited

FOREIGN PATENT DOCUMENTS

| | | | |
|---|---|---|---|
| JP | 2008114997 A * | 5/2008 | |
| JP | 2009-137762 | 6/2009 | |
| JP | 2011-162355 | 8/2011 | |
| JP | 2012-062127 | 3/2012 | |

* cited by examiner

IMAGE FORMING APPARATUS AND SHEET POSITIONING DEVICE USING METHOD OF SHEET POSITIONING

CROSS-REFERENCE TO RELATED APPLICATIONS

This patent application is based on and claims priority pursuant to 35 U.S.C. §119 to Japanese Patent Application Nos. 2012-093580 and 2012-124086, filed on Apr. 17, 2012 and May 31, 2012, respectively, in the Japan Patent Office, the entire disclosures of which are hereby incorporated by reference herein.

BACKGROUND

1. Technical Field

Embodiments of the present invention relate to an image forming apparatus such as a copier, printer, facsimile machine, a multifunctional machine having functions of the copier, printer, and facsimile machine, and so forth, a sheet positioning device that supplies recording media for producing prints and copies, and a method of sheet positioning used for the sheet positioning device that is includable in the image forming apparatus.

2. Related Art

Known image forming apparatuses such as copiers and printers employ a sheet supplying device having a technique in which a pair of side fences automatically slides to sandwich and contact lateral edges of a sheet.

For example, Japanese Patent Application Publication Nos. 2011-162355 (JP-2011-162355-A) and 2012-062127 (JP-2012-062127-A) disclose sheet positioning devices (paper storage devices) in which a pair of side fences (side fences) is disposed at both lateral ends of a sheet setting member (table or surface). When a sheet is placed on the sheet setting member, a controller starts driving a drive motor to slide the pair of side fences to sandwich the sheet at both lateral ends. When contact between the pair of side fences and the sheet is detected, the controller stops driving the drive motor to stop moving the side fences. Such an action to regulate the pair of side fences to sandwich both lateral edges of the sheet can reduce or to eliminate skewing of the sheet when feeding the sheet forward for printing, lateral mispositioning of the sheet, and wrinkling of the sheet.

Further, with the configuration in which the pair of side fences slides automatically, the sheet can be aligned more correctly compared to aligning the sheet by sliding the pair of side fences manually.

However, known sheet supplying devices have sometimes caused the pair of side fences to be out of a target position due to inertia when the controller stops driving the drive motor after a detector (or detectors) detects contact of the sheet and the pair of side fences in the lateral direction. Further, sheets of different thickness or a significant change in the number of sheets set on the sheet setting member prevents the detector from detecting contact of the sheet and the pair of side fences in the lateral direction correctly. As a result, the sheet is skewed when fed, lateral mispositioning, wrinkling thereon.

SUMMARY

The present invention provides a novel image forming apparatus including an image forming device to form an image on a surface of a sheet of recording media and a sheet positioning device to position the sheet before feeding the sheet to the image forming device. The sheet positioning device includes a sheet setting plate to accommodate the sheet of recording media set thereon, a pair of side fence units disposed facing each other along opposite sides of the sheet setting plate and configured to move in the lateral direction perpendicular to a conveyance direction of the sheet on the sheet setting plate, a moving mechanism disposed on a back side of the sheet setting plate and configured to move the pair of side fence units in the lateral direction, a contact member disposed to at least one of the pair of side fence units, protruding from a surface of the one of the pair of side fence units toward a center thereof in the lateral direction and configured to contact a lateral end of the sheet and press the sheet in the lateral direction, a position detector to detect the position of the contact member in the lateral direction on the sheet setting plate, and a controller configured to control the moving mechanism to move and stop the pair of side fence units in the lateral direction. The controller is configured to start the moving mechanism to move the pair of side fence units in the lateral direction for approximate positioning when the sheet is placed on the sheet setting plate, stop the moving mechanism to halt movement of the pair of side fence units after the contact member has contacted and pressed the lateral end of the sheet, allow the position detector to detect the position of the pair of side fence units while the pair of side fences remains stopped, and restart the moving mechanism to move the pair of side fence units in the lateral direction based on detection results obtained by the position detector for precise positioning of the pair of side fence units.

When the sheet is placed on the sheet setting plate and the contact member contacts the lateral end of the sheet, the controller may start the moving mechanism to separate the pair of side fence units from each other and then to approach each other to approach the sheet in the lateral direction, stop the moving mechanism to halt movement of the pair of side fence units after the contact member has contacted and pressed the lateral end of the sheet, allow the position detector to detect the position of the pair of side fence units while the pair of side fences remains stopped, and restart the moving mechanism to move the pair of side fence units to approach each other in the lateral direction again based on the detection result obtained by the position detector for the precise positioning of the pair of side fence units in the lateral direction. When the sheet is placed on the sheet setting plate and the contact member is not in contact with the lateral end of the sheet, the controller may start the moving mechanism to approach the pair of side fence units each other to approach the sheet in the lateral direction, stop the moving mechanism to halt movement of the pair of side fence units after the contact member has contacted and pressed the lateral end of the sheet, allow the position detector to detect the position of the pair of side fence units while the pair of side fences remains stopped, and restart the moving mechanism to move the pair of side fence units to approach each other in the lateral direction again based on the detection result obtained by the position detector for the precise positioning of the pair of side fence units in the lateral direction.

When the sheet is placed on the sheet setting plate and the contact member contacts the lateral end of the sheet, the controller may start the moving mechanism to separate the pair of side fence units from each other and then approach each other to approach the sheet in the lateral direction, cause the moving mechanism to move the pair of side fence units to further approach each other by a given distance after the contact member contacts the lateral end of the sheet and then separate from each other, start the moving mechanism to move the pair of side fence units to approach each other, stop the moving mechanism to halt movement of the pair of side fence units after the contact member has contacted and pressed the lateral end of the sheet, allow the position detector to detect the position of the pair of side fence units while the pair of side fence units remains stopped, and restart the moving mechanism to move the pair of side fence units to approach each other in the lateral direction again based on the detection result obtained by the position detector for the precise positioning of the pair of side fence units in the lateral direction. When the sheet is placed on the sheet setting plate and the contact member remains separated from the lateral end of the sheet, the controller may start the moving mechanism to move the pair of side fence units to approach each other to approach the sheet in the lateral direction, cause the moving mechanism to move the pair of side fence units to further approach each other by a given distance after the contact member contacts the lateral end of the sheet and then separate from each other, start the moving mechanism to move the pair of side fence units to approach each other, stop the moving mechanism to halt movement of the pair of side fence units after the contact member has contacted and pressed the lateral end of the sheet, allow the position detector to detect the position of the pair of side fence units while the pair of side fence units remains stopped, and restart the moving mechanism to move the pair of side fence units to approach each other in the lateral direction again based on the detection result obtained by the position detector for the precise positioning of the pair of side fence units in the lateral direction.

The position detector may include a Hall effect sensor to move in the lateral direction together with the at least one of the pair of side fence units and a magnet disposed facing the Hall effect sensor to move along with the contact member in the lateral direction. Based on an output of the Hall effect sensor, the position detector may detect that the contact member is in contact with the lateral end of the sheet and an amount of change of movement of the contact member in the lateral direction.

The position detector may include a comparator to output a signal to stop moving the pair of side fence units when the output of the Hall effect sensor reaches a predetermined threshold value indicating that the contact member is in contact with the lateral end of the sheet.

The position detector may be calibrated in a manufacturing process with at least the moving mechanism, the pair of side fence units, and the contact member.

The moving mechanism may include a stepping motor. The controller may start, stop, and restart the moving mechanism to move and stop the pair of side fence units based on pulse control of the stepping motor.

Further, the present invention provides a novel sheet positioning device a sheet setting plate to accommodate a sheet of recording media set thereon, a pair of side fence units disposed facing each other along opposite of the sheet setting plate and configured to move in a lateral direction perpendicular to a conveyance direction of the sheet on the platen, a moving mechanism disposed on a back side of the sheet setting plate, and configured to move the pair of side fence units in the lateral direction, a contact member disposed to at least one of the pair of side fence units, protruding from a surface of the one of the pair of side fence units toward a center in the lateral direction and configured to contact a lateral end of the sheet and press the sheet in the lateral direction, a position detector to detect the position of the contact member in the lateral direction on the sheet setting plate, and a controller configured to control the moving mechanism to move and stop the pair of side fence units in the lateral direction. The controller is configured to start the moving mechanism to move the pair of side fence units in the lateral direction for approximate positioning when the sheet is placed on the sheet setting plate, stop the moving mechanism to halt movement of the pair of side fence units after the contact member has contacted and pressed the lateral end of the sheet, allow the position detector to detect the position of the pair of side fence units while the pair of side fences remains stopped, and restart the moving mechanism to move the pair of side fence units in the lateral direction based on detection results obtained by the position detector for precise positioning of the pair of side fence units.

Further, the present invention describes a novel method of positioning a sheet from a sheet setting plate including starting a moving mechanism to move a pair of side fence units disposed facing each other along opposite sides of the sheet setting plate in a lateral direction when the sheet is placed on the sheet setting plate for approximate positioning, stopping the moving mechanism to halt movement of the pair of side fence units after a contact member disposed to at least one of the pair of side fence units has contacted and pressed a lateral end of the sheet, allowing a position detector to detect the position of the pair of side fence units while the pair of side fences remains stopped, and restarting the moving mechanism to move the pair of side fence units in the lateral direction based on detection results obtained by the position detector for precise positioning of the pair of side fence units.

The above-described method of positioning may further include starting the moving mechanism to move the pair of side fence units to approach each other based on a detection result obtained by a setting detection sensor, stopping the moving mechanism to halt movement of the pair of side fence units based on a signal issued by a comparator, checking a current output of a Hall effect sensor, converting the output to a distance of movement of the pair of side fence units, rotating the moving mechanism by a given pulse, and stopping the moving mechanism after rotating the moving mechanism by the given pulse.

The above-described method of positioning may further include, when the sheet is placed on the sheet setting plate and the contact member contacts the lateral end of the sheet, starting the moving mechanism to separate the pair of side fence units from each other and then to approach each other to approach the sheet in the lateral direction, stopping the moving mechanism to halt movement of the pair of side fence units after the contact member has contacted and pressed the lateral end of the sheet, allowing the position detector to detect the position of the pair of side fence units while the pair of side fences remains stopped, and restarting the moving mechanism to move the pair of side fence units to approach each other in the lateral direction again based on the detection result obtained by the position detector for the precise positioning of the pair of side fence units in the lateral direction, and when the sheet is placed on the sheet setting plate and the contact member is not in contact with the lateral end of the sheet, starting the moving mechanism to approach the pair of side fence units each other to approach the sheet in the lateral direction, stopping the moving mechanism to halt movement of the pair of side fence units after the contact member has contacted and pressed the lateral end of the sheet, allowing the position detector to detect the position of the pair of side fence units while the pair of side fences remains stopped, and restarting the moving mechanism to move the pair of side fence units to approach each other in the lateral direction again based on the detection result obtained by the position detector for the precise positioning of the pair of side fence units in the lateral direction.

The above-described method of positioning may further include, when the sheet is placed on the sheet setting plate and the contact member contacts the lateral end of the sheet, starting the moving mechanism to separate the pair of side fence units from each other and then approach each other to approach the sheet in the lateral direction, causing the moving mechanism to move the pair of side fence units to further approach each other by a given distance even after the contact member contacts the lateral end of the sheet and then separate from each other, starting the moving mechanism to move the pair of side fence units to approach each other, stopping the moving mechanism to halt movement of the pair of side fence units after the contact member has contacted and pressed the lateral end of the sheet, allowing the position detector to detect the position of the pair of side fence units while the pair of side fences remains stopped, and restarting the moving mechanism to move the pair of side fence units to approach each other in the lateral direction again based on the detection result obtained by the position detector for the precise positioning of the pair of side fence units in the lateral direction, and when the sheet is placed on the sheet setting plate and the contact member remains separated from the lateral end of the sheet, starting the moving mechanism to move the pair of side fence units to approach each other to approach the sheet in the lateral direction, causing the moving mechanism to move the pair of side fence units to further approach each other by a given distance after the contact member contacts the lateral end of the sheet and then separate from each other, starting the moving mechanism to move the pair of side fence units to approach each other, stopping the moving mechanism to halt movement of the pair of side fence units after the contact member has contacted and pressed the lateral end of the sheet, allowing the position detector to detect the position of the pair of side fence units while the pair of side fences remains stopped, and restarting the moving mechanism to move the pair of side fence units to approach each other in the lateral direction again based on the detection result obtained by the position detector for the precise positioning of the pair of side fence units in the lateral direction.

The above-described method of positioning may further include determining whether or not outputs of two Hall effect sensors are equal to or greater than a threshold value, separating the pair of side fence units from each other, halting movement of the pair of side fence units when at least one output of the Hall effect sensors is smaller than the threshold value, moving the pair of side fence units to approach each other, further moving the pair of side fence units to approach each other by a predetermined distance, halting movement of the pair of side fence units when both of the outputs of the Hall effect sensors become equal to or greater than the threshold value, separating the pair of side fence units from each other, stopping the pair of side fence units when at least one output of the Hall effect sensors is smaller than the predetermined threshold, moving the pair of side fence units to approach each other, stopping the pair of side fence units when both outputs of the Hall effect sensors are greater than the predetermined threshold, calculating a sum total of space between the sheet from the pair of side fence units based on the outputs from the Hall effect sensor while the pair of side fence units remains stopped, moving the pair of side fence units toward respective target positions based on the calculation result, and stopping the pair of side fence units at the target positions.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
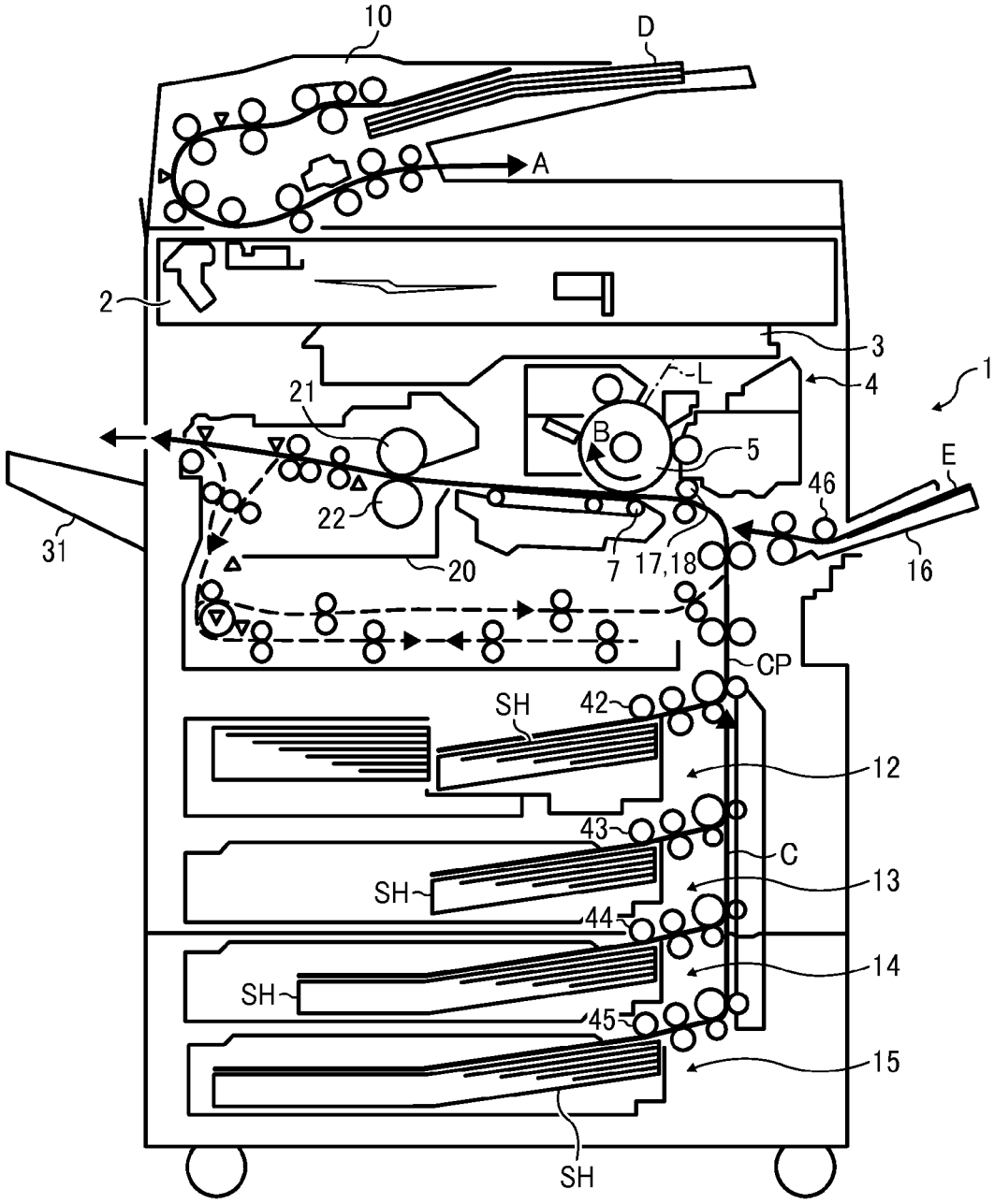
FIG. 1 is a diagram illustrating a schematic configuration of an image forming apparatus according to Embodiment 1 of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

It is to be noted that "lateral direction" is defined as a direction perpendicular to a sheet conveyance direction or a direction in which a sheet is conveyed and that "sheet" is defined as a sheet-like recording medium such as a transfer sheet, an overhead projector (OHP) sheet, and even an original document that is fed in an automatic original document feeder serving as a sheet positioning device.

[Embodiment 1]

Referring to FIGS. 1 through 8, descriptions are given of a sheet positioning device according to Embodiment 1 of the present invention.

Firstly, the entire configuration and functions of an image forming apparatus 1 are explained in reference to FIG. 1 that illustrates a schematic configuration of an image forming apparatus 1 according to Embodiment 1 of the present invention.

The image forming apparatus 1 corresponds to a copier and includes an original document reader 2, an optical writing device 3, an image forming device 4, a transfer device 7, an original document feeder (automatic document feeder) 10, sheet cassettes (sheet positioning devices) 12 through 15, a sheet positioning device 16, registration rollers 17 and 18, a fixing device 20, a fixing roller 21, a pressure roller 22, a sheet discharging tray 31, and feed rollers 42 through 46.

The original document reader 2 optically reads image data of an original document D. The optical writing device 3 emits a laser light beam L based on the image data read by the original document reader 2 to a surface of a photoconductor drum 5. The image forming device 4 serves as an image forming portion and forms a toner image on the surface of the photoconductor drum 5. The transfer device 7 serves as an image forming portion and transfers the toner image formed on the surface of the photoconductor drum 5 onto a sheet SH serving as a sheet or a recording medium. The original document feeder (automatic document feeder) feeds an original document D set thereon toward the original document reader 2. The sheet cassettes 12 through 15 serve as sheet positioning devices and accommodate a stack of papers P. The sheet positioning device 16 is a bypass sheet feeder to feed the sheet SH from a bypass route that is different from the sheet cassettes 12 through 15. The registration rollers 17 and 18 serve as timing rollers to convey the sheet SH toward the transfer device 7. The fixing device 20 fixes a toner image (non-fixed image) to the sheet SH. The fixing roller 21 and the pressure roller 22 are disposed in the fixing device 20 to press the sheet SH therebetween. The sheet discharging tray 31 receives and holds the sheet SH discharged from the image forming apparatus 1. The feed rollers 42 through 46 are disposed to the sheet positioning device 12 through 16.

A description is given of a normal image forming operation performed by the image forming apparatus 1, with reference to FIG. 1.

The original document D is fed and conveyed by a feed roller of the original document feeder 10 from an original document table in a direction indicated by arrow A and passes over the original document reader 2, image data of the original document D is optically read. The optical image data read by the original document reader 2 is converted to electric signals, and thereafter transmitted to the optical writing device 3. Then, the optical writing device 3 emits the laser light beam L based on the image data converted to the electric signals toward the surface of the photoconductor drum 5 of the image forming device 4.

In the image forming device 4, the photoconductor drum 5 rotates in a clockwise direction B in FIG. 1 so as to form an image after image forming processes such as charging, exposure, and development. Thereafter, the image formed on the surface of the photoconductor drum 5 is transferred by the transfer device 7 of the image forming device 4 onto the surface of the sheet SH that is conveyed by the registration rollers 17 and 18.

The sheet SH that is conveyed to the transfer device 7 in the image forming device 4 is handled as follows.

Depending on types of prints, one sheet cassette of the sheet cassettes 12 through 15 of the image forming apparatus 1 is selected automatically or manually.

For example, when the uppermost cassette 12 is selected, an uppermost sheet of papers P accommodated in the sheet cassette 12 is fed by the feed roller 42 in a direction indicated by arrow C and conveyed toward a sheet conveyance path CP. Then, the sheet SH passes through the sheet conveyance path CP having a plurality of conveyance rollers therein, and reaches the registration rollers 17 and 18.

By contrast, when the sheet positioning device 16 that is a bypass sheet feeder disposed on the side of the image forming apparatus 1 is selected, the sheet SH or the uppermost paper of the papers P loaded on a sheet setting plate 51 of the sheet positioning device 16 is fed by the feed roller 46 and conveyed in a direction indicated by arrow E toward the sheet conveyance path CP, and reaches the registration rollers 17 and 18.

The sheet SH that has reached the registration rollers 17 and 18 is conveyed toward the transfer device 7, synchronized with movement of the toner image formed on the surface of the photoconductor drum 5 for matching the image position.

The sheet SH after the transfer process passes the sheet conveyance path CP and reaches the fixing device 20. The sheet SH is then conveyed between the fixing roller 21 and the pressure roller 22 to be fixed by application of heat and pressure provided by the fixing roller 21 and the pressure roller 22, which is a fixing process. After the fixing process, the sheet SH having the toner image thereon is discharged from a nip portion of the fixing roller 21 and the pressure roller 22 to the outside the image forming apparatus 1, and received by the sheet discharging tray 31.

Thus, a series of image forming process is completed.

A description is given of details of the sheet positioning device 16 in Embodiment 1, with reference to FIGS. 2 through 8.

Figure 2:
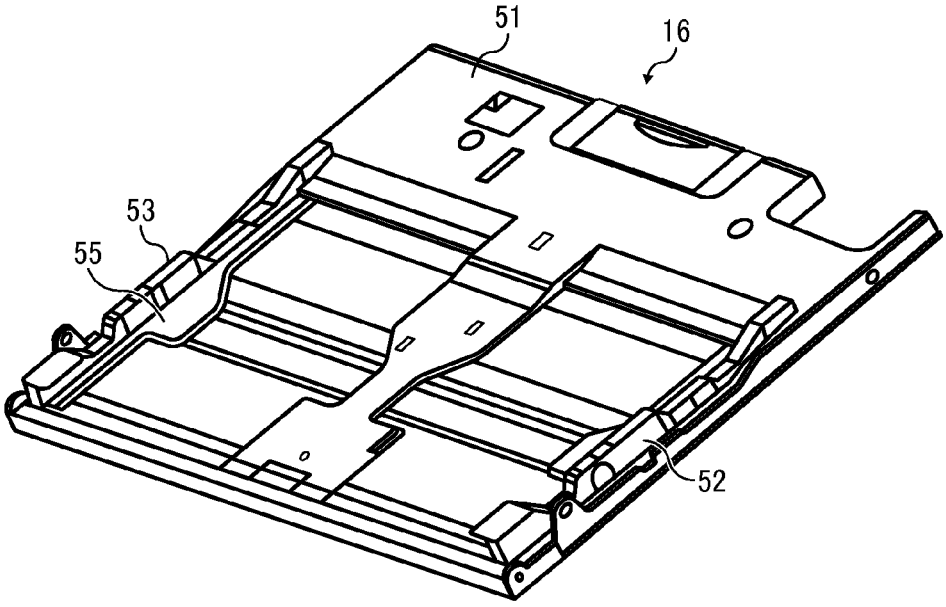
FIG. 2 is a perspective view illustrating an external appearance of a sheet positioning device included in the image forming apparatus of FIG. 1.
Figure 3:
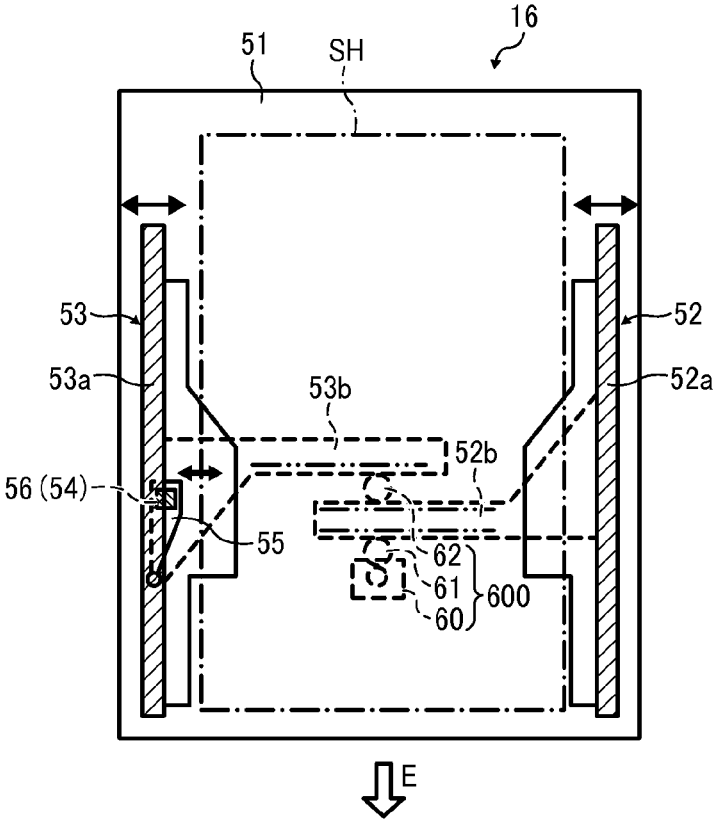
FIG. 3 is a top view illustrating a schematic configuration of the sheet positioning device of FIG. 2.

As illustrated in FIGS. 2 and 3, the sheet positioning device 16 includes the sheet setting plate 51 serving as a base member, a first side fence unit 52 and a second side fence unit 53 serving as a pair of side fences, a moving mechanism 600, a contact member 55 serving as a projection, a position detector 500 including a Hall effect sensor 54 and a magnet 56, and the feed roller 46 serving as a sheet feeder (see FIG. 1).

The sheet setting plate 51 has a substantially member on which a user loads at least one sheet SH. The sheet SH on the sheet setting plate 51 is fed and conveyed by the feed roller 46 in the direction E.

The first side fence unit 52 and the second side fence unit 53 serving as a pair of side fences are disposed at lateral ends of the sheet setting plate 51, which is a left-to-right direction in FIG. 2 and a direction perpendicular to the drawing sheet of FIG. 1. The first side fence unit 52 and the second side fence unit 53 are movable operated by the moving mechanism 600 in a lateral direction to sandwich the sheet SH placed on the sheet setting plate 51.

Specifically, the first side fence unit 52 disposed on one end in the lateral direction of the sheet SH mainly includes a fence 52*a* and a rack gear unit 52*b*.

The fence 52*a* is disposed to protrude and stand upward in a vertical direction from the surface of the sheet setting plate 51. The fence 52*a* contacts the ends of the sheet SH in the lateral direction to regulate the setting position of the sheet SH.

The rack gear unit 52*b* is disposed to not to protrude from the surface of the sheet setting plate 51 but to extend in the lateral direction on the back side of the sheet setting plate 51. The rack gear unit 52*b* includes two rack gears, one is drawn with a two-dot chain line at one end in a sheet feeding direction, which is a vertical direction of FIG. 3, to mesh with a first pinion gear 61 and the other is drawn with a two-dot chain line at the other end in the sheet feeding direction to mesh with a second pinion gear 62.

Similarly, the second side fence unit 53 disposed on the other end in the lateral direction of the sheet SH mainly includes a fence 53*a* and a rack gear unit 53*b*.

The fence 53*a* is disposed to protrude and stand upward in a vertical direction from the surface of the sheet setting plate 51. The fence 53*a* contacts the ends of the sheet SH in the lateral direction to regulate the setting position of the sheet SH.

The rack gear unit 53*b* is disposed to not to protrude from the surface of the sheet setting plate 51 but to extend in the lateral direction on the back side of the sheet setting plate 51. The rack gear unit 53*b* includes one rack gear drawn with a two-dot chain line at one end in the sheet feeding direction to mesh with the second pinion gear 62.

It is to be noted that the second side fence unit 53 includes the contact member 55 that projects toward the center in the lateral direction of the sheet SH, which will described later.

The moving mechanism 600 is disposed on the back side of the sheet setting plate 51, which is same as the rack gear units 52*b* and 53*b* of the first and second side fences 52 and 53, respectively, and moves the first side fence unit 52 and the second side fence unit 53 in the lateral direction of the sheet SH. The moving mechanism 600 includes a stepping motor 60 serving as a driving source, the first pinion gear 61, the second pinion gear 62, and so forth. Specifically, the stepping motor 60 has a shaft with a driving gear meshing the first pinion gear 61 attached thereto. The second pinion gear 62 is disposed between the rack gear unit 52*b* of the first side fence unit 52 and the rack gear unit 53*b* of the second side fence unit 53 to mesh with both of their rack gears.

With this configuration, when the stepping motor 60 starts rotating in a normal direction, the first side fence unit 52 and the second side fence unit 53 disposed facing each other move together toward the center therebetween. By contrast, when the stepping motor 60 starts rotating in an opposite or reverse direction, the first side fence 61 and the second side fence 62 separate from each other to widen the space therebetween in a direction indicated by bi-directional arrows.

Figure 4A:
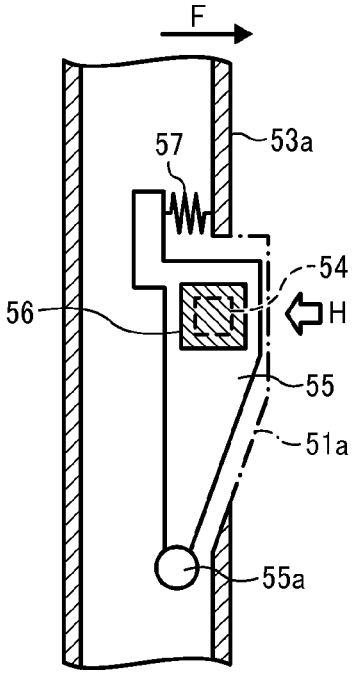
FIG. 4A is an enlarged cross-sectional view illustrating a contact member of a side fence.
Figure 4B:
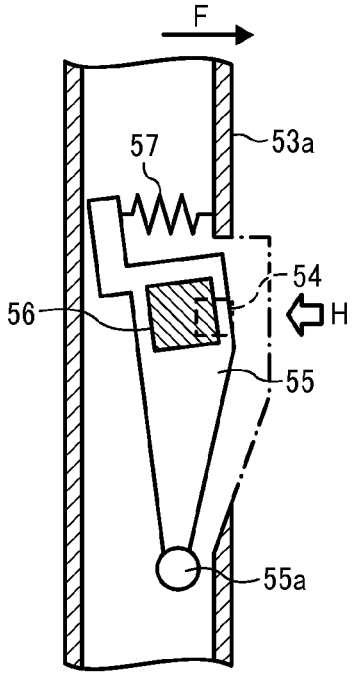
FIG. 4B is an enlarged cross-sectional view illustrating the contact member of a side fence.

In Embodiment 1, the contact member 55 serving as a projection member is attached to the fence 53*a* of the second side fence unit 53. Referring to FIGS. 3, 4A and 4B, the contact member 55 is disposed to protrude from the surface of the fence 53*a* of the second side fence unit 53 toward the center in the lateral direction (to the right side of FIG. 3). That is, when the second side fence unit 53 moves from a separate position where the first side fence unit 52 and the second side fence unit 53 remain separate from each other near lateral ends of the sheet setting plate 51 to a contact position where the first side fence unit 52 and the second side fence unit 53 are close enough to contact the sheet SH placed on the sheet setting plate 51, the contact member 55 contacts the lateral end of the sheet SH before the surface of the fence 53*a* of the second side fence unit 53. Then, the contact member 55 presses the sheet SH further in the lateral direction.

Specifically, as illustrated in FIGS. 4A and 4B, one end of the contact member 55 is attached to the second side fence unit 53 such that the contact member 55 is rotatable about a pivot 55*a*. The other end of the contact member 55 is connected to one end of a hook of a tension spring 57 that serves as a biasing member to bias the contact member 55 toward the center in the lateral direction on the sheet setting plate 51 with a mild tension force. The other end of the hook of the tension spring 57 is fixed to the fence 53*a* of the second side fence unit 53.

According to a step provided downwardly from the surface of the sheet setting plate 51, a stopper 51*a* is provided to position the contact member 55 biased by the tension spring 57 toward the center in the lateral direction.

With such a configuration, when not in contact with the sheet SH, the contact member 55 is biased by the tension spring 57 and remains in contact with the stopper 51*a* with a part of which projecting from the surface of the fence 53*a* of the second side fence unit 53, as illustrated in FIG. 4A.

By contrast, when the contact member 55 contacts the sheet SH along with movement of the second side fence unit 53 caused by the moving mechanism 600 in a direction indicated by arrow F shown in FIG. 4B, the contact member 55 is pressed by the sheet SH and is rotated in a counterclockwise direction about the pivot 55*a* against the biasing force of the tension spring 57 and moves from the projected position to the lateral end of the sheet setting plate 51. When the surface of the fence 53*a* of the second side fence unit 53 contacts the sheet SH, the contact member 55 retreats to the position where the contact member 55 does not project from the surface of the fence 53*a* of the second side fence unit 53, as illustrated in FIG. 4B.

As described above, the sheet positioning device 16 of Embodiment 1 includes the position detector 500 to detect the position of the contact member 55 in the lateral direction on the sheet setting plate 51. Details of the position detector 500 will be described later.

When the sheet SH is placed on the sheet setting plate 51, a controller 400, which will be described later, controls to start the moving mechanism 600 to move the pair of side fence units 52 and 53 in the lateral direction for approximate positioning. After the contact member 55 has contacted the lateral end of the sheet SH and pressed the sheet SH in the lateral direction thereof, the controller 400 stops the moving mechanism 600 to halt movement of the pair of side fence units 52 and 53 to allow the position detector 500 to detect the position of the contact member 55 while the pair of side fences remains stopped. Based on the detection results obtained by the position detector 500, the controller 400 restarts the moving mechanism 600 to move the pair of side fence units 52 and 53 in the lateral direction again for precise positioning of the pair of side fence units, thereby positioning the pair of side fence units 52 and 53 in the lateral direction correctly.

The position detector 500 includes the Hall effect sensor 54, the magnet 56 that serves as a magnetic field generator, and the controller 400.

Figure 6:
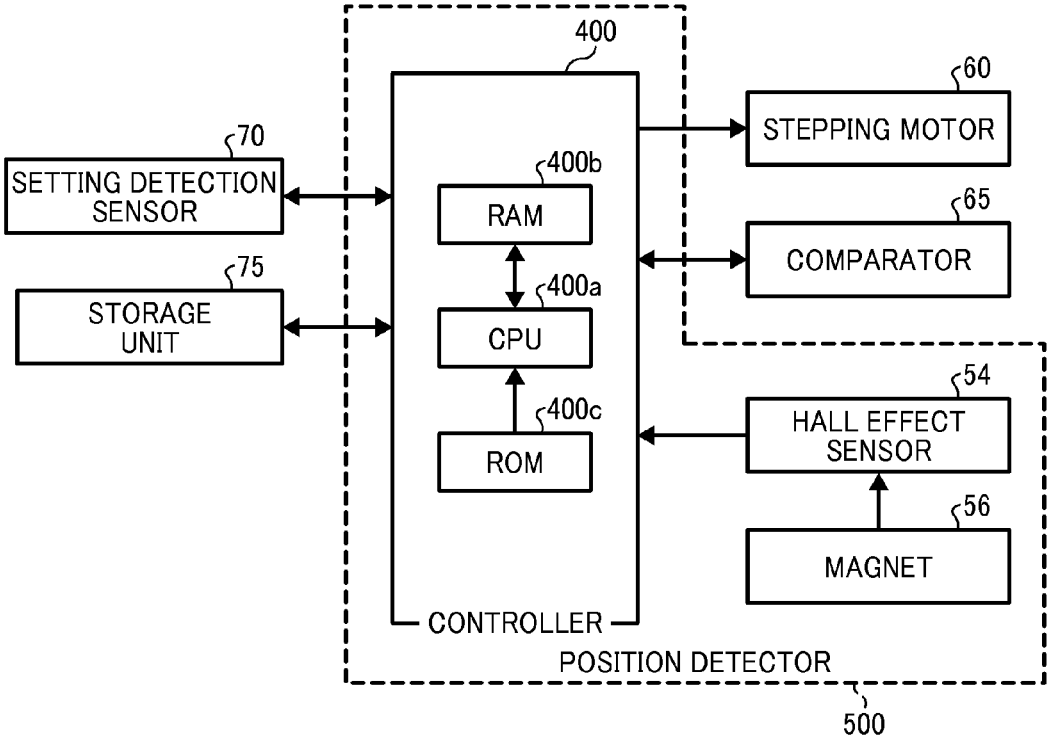
FIG. 6 is a diagram illustrating a controller and units connected to the controller.

It is to be noted that the controller 400 as illustrated in FIG. 6 includes a central processing unit (CPU) 400*a*, a random access memory (RAM) 400*b*, and a read-only memory (ROM) 400*c*, and is connected to the stepping motor 60, a comparator 65, a setting detection sensor 70, a storage unit 75, and so forth. The controller 400 can be included in the image forming apparatus 1, a sheet positioning unit of a large size that does not include an image forming device, or any suitable unit or device. In Embodiment 1, the controller 400 is included in the image forming apparatus 1.

Figure 5:
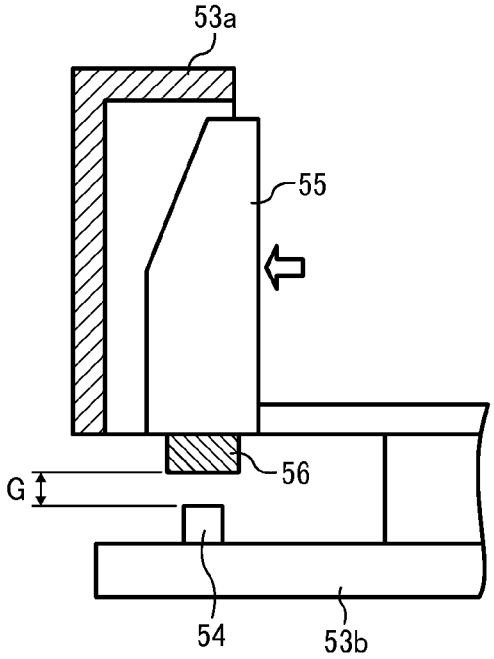
FIG. 5 is a diagram illustrating a positional relation in height of a Hall effect sensor and a magnet disposed on the side fence.

As illustrated in FIGS. 4A, 4B, and 5, the Hall effect sensor 54 is fixedly attached to an upper surface of the lateral end of the rack gear unit 53*b*, on the back side of the sheet setting plate 51. The Hall effect sensor 54 moves in the lateral direction together with the second side fence unit 53 that is driven by the moving mechanism 600.

The magnet 56 is fixedly attached to the bottom of the contact member 55, which is the back side of the sheet setting plate 51 and is disposed facing the Hall effect sensor 54. The magnet 56 moves along with the contact member 55 in the lateral direction.

Based on the output of the Hall effect sensor 54, the position detector 500 detects that the contact member 55 is in contact with the lateral end of the sheet SH and an amount of change of movement of the contact member 55 in the lateral direction. Specifically, when the sheet SH presses the contact member 55, the contact member 55 rotates, and the magnet 56 fixed to the contact member 55 moves together with the contact member 55. Therefore, the relative position of the magnet 56 with respect to the Hall effect sensor 54 changes, and the Hall effect sensor 54 detects the change in magnetic field. According to the output of the Hall effect sensor 54, the state of the contact member 55 contacting the lateral end of the sheet SH and the amount of change of the contact member 55 can be detected. It is to be noted that the amount of change of the contact member 55 is proportionate to the output (analog) voltage of the Hall effect sensor 54, and the amount of change of the contact member 55 is obtained by the controller 400 based on the output voltage of the Hall effect sensor 54.

Thus, in the sheet positioning device 16 in Embodiment 1, the controller 400 first starts the moving mechanism 600 to move the first side fence unit 52 and the second side fence unit 53 and then, when the Hall effect sensor 54 detects that the contact member 55 contacts the sheet SH in the lateral direction, the controller 400 stops driving the stepping motor 60 to stop the first side fence unit 52 and the second side fence unit 53. While the fence units 52 and 53 remain stopped, the controller 400 restarts the stepping motor 60 based on the amount of change of the contact member 55 (in the lateral direction) detected by the Hall effect sensor 54, and moves the first side fence unit 52 and the second side fence unit 53 in the lateral direction. With this operation, regardless of types (rigidity, thickness, and so forth) or amounts of the sheet SH, the respective stop positions of the first side fence unit 52 and the second side fence unit 53 or the positions where the lateral ends of the sheet SH are regulated are optimized reliably, thereby substantially reducing errors such as the sheet SH is fed while the sheet SH is skewed, shifted, or wrinkled.

Specifically, in Embodiment 1, when the first side fence unit 52 and the second side fence unit 53 move, their positions are roughly aligned before the contact member 55 contacts the sheet SH. Thereafter, based on the position of the contact member 55 detected while the first side fence unit 52 and the second side fence unit 53 are stopped, the positions of the first side fence unit 52 and the second side fence unit 53 are roughly aligned, resulting in that the first side fence unit 52 and the second side fence unit 53 can be positioned precisely to the target positions to interpose the sheet SH. Since the sheet positioning device 16 according to Embodiment 1 employs the Hall effect sensor 54 whose detection accuracy demands micro order, the positioning can be conducted highly precisely. Therefore, even if the stepping motor 60 stops irregularly in the initial approximate positioning operation or the position of the first side fence unit 52 and the second side fence unit 53 shift from the target positions due to inertia, the positions of the first side fence unit 52 and the second side fence unit 53 can be calibrated to the target positions in the precise positioning operation reliably. Therefore, the speed of movement of the first side fence unit 52 and the second side fence unit 53 in the initial approximate positioning operation can be increased while the speed of movement thereof in the precise positioning operation can be reduced. That is, the driving speed of the stepping motor 60 can be varied.

As illustrated in FIG. 6, the position detector 500 according to Embodiment 1 further includes the comparator 65. The comparator 65 outputs a signal that is an analog voltage to cause the moving mechanism 600 to stop moving the pair of side fence units 52 and 53, such as that the contact member 55 is in contact with the lateral end of the sheet SH when the output of the Hall effect sensor 54 reaches a predetermined threshold value that is a set voltage. As illustrated in FIG. 6, the comparator 65 is connected to the controller 400, which is the same as the Hall effect sensor 54.

With the comparator 65, the controller 400 including the CPU 400*a* can avoid repeat of calculation of the amount of change of the contact member 55 based on the output of the Hall effect sensor 54. That is, when the output of the Hall effect sensor 54 reaches the threshold value, the output (the output signal) is transmitted to the CPU 400*a* of the controller 400 and the change amount of the contact member 55 is calculated based on the output, thereby reducing loads to the CPU 400*a* of the controller 400.

Figure 7:
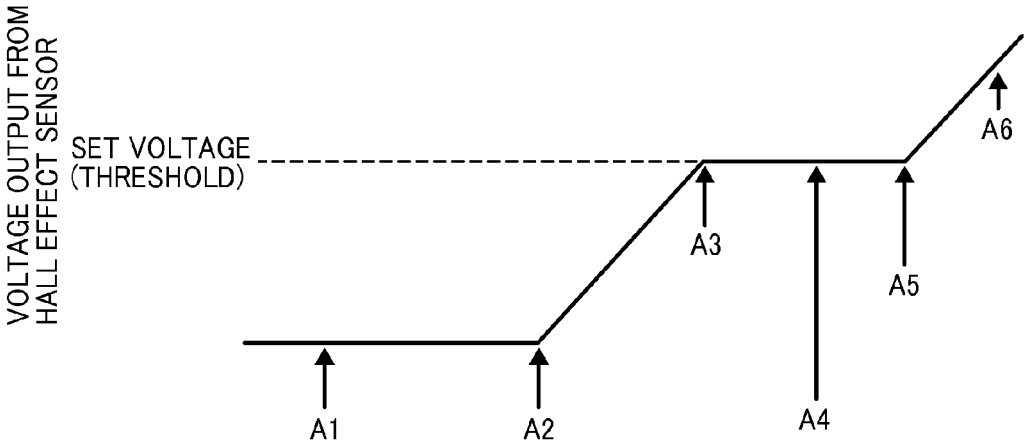
FIG. 7 is a diagram illustrating changes of the Hall effect sensor in response to movement of the side fence.

FIG. 7 is a diagram illustrating changes of the Hall effect sensor 54 in response to movement of the first side fence unit 52 and the second side fence unit 53 from the lateral ends of the sheet setting plate 51 (the sheet SH) toward the center in the lateral direction.

As illustrated in FIG. 7, when a user places the sheet SH on the sheet setting plate 51, the setting detection sensor 70 that is a photosensor disposed on the surface of the sheet setting plate 51 detects the sheet SH, that state is reported to the controller 400, and the controller 400 starts driving the stepping motor 60 to move the first side fence unit 52 and the second side fence unit 53 (action "A1"). At this time, the contact member 55 is located at the home position (FIG. 4A) and has not yet contacted the sheet SH. Therefore, the output voltage of the Hall effect sensor 54 is low.

When the contact member 55 contacts the sheet SH along with the movement of the first side fence unit 52 and the second side fence unit 53 toward the center of the sheet setting plate 51 in the lateral direction (action "A2"), the output voltage of the Hall effect sensor 54 gradually increases according to the amount of change in position of the contact member 55. When the output voltage of the Hall effect sensor 54 reaches the set voltage (the threshold), the controller 400 issues a signal to stop driving the stepping motor 60 on the assumption that the contact member 55 is completely in contact with the sheet SH (action "A3"). Thereafter, a space between the first side fence unit 52 and the second side fence unit 53 (i.e., the position of the contact member 55) is calculated based on the output of the Hall effect sensor 54. The result shown in FIG. 7 is calculated that the output of the Hall effect sensor 54 corresponds to the set value for convenience (action "A4").

Then, to optimize the position of the first side fence unit 52 and the second side fence unit 53 based on the space for the sheet SH therebetween, the controller 400 starts driving the stepping motor 60 again to precisely fit the positions of the first side fence unit 52 and the second side fence unit 53 (action "A5"). After the stepping motor 60 is stopped (action "A6"), the positions of the first side fence unit 52 and the second side fence unit 53 are optimized, and the sheet SH becomes ready to be fed from the sheet positioning device 16.

As described above, the sheet positioning device 16 of Embodiment 1 employs the stepping motor 60 as a driving source of the moving mechanism 600 so that the moving mechanism 600 can move the pair of side fence units 52 and 53 from the stopped position based on pulse control of the stepping motor 60.

With this configuration, the first side fence unit 52 and the second side fence unit 53 can be positioned with high accuracy without using a high-performance CPU. Specifically, if a DC motor is employed as a driving source of the moving mechanism 600, the driving period is calculated by dividing a distance to move the side fence units 52 and 53 by the speed. This demands a timer to control the driving period, which may need a high-performance, expensive CPU. By contrast, when the stepping motor 60 is employed as the driving source of the moving mechanism 600 as in Embodiment 1, an operation pulse of the stepping motor 60 is obtained based on the amount of movement of the first side fence unit 52 and the second side fence unit 53 at rotation by one pulse of the stepping motor 60 and the distance of movement of the first side fence unit 52 and the second side fence unit 53 for precise positioning, so that the stepping motor 60 is driven. With the result obtained by the above-described actions, the first side fence unit 52 and the second side fence unit 53 can be positioned precisely with accuracy.

Further, the Hall effect sensor 54 in the sheet positioning device 16 according to Embodiment 1 can be calibrated in a manufacturing process, with at least the moving mechanism 600, the pair of side fence units 52 and 53, the contact member 55, and the position detector 500 including the Hall effect sensor 54 and the magnet 56 assembled to the sheet setting plate 51. This calibration is performed because the slope of the proportional expression of the voltage of the Hall effect sensor 54 and the amount of change of the contact member 55 changes when there is variation in a gap G (see FIG. 5) formed between the magnet 56 and the Hall effect sensor 54 and in accuracy of dimension and/or assembly of units and components to determine the relation in position of the magnet 56 and the Hall effect sensor 54 in the lateral direction. Therefore, after those units and components have been assembled, the controller 400 obtains at least two data indicating the relation of the voltage of the Hall effect sensor 54 and the amount of change of the contact member 55, calculates the slop of the above-described proportional expression based on the data, and inputs the result to the storage unit 75. By so doing, the first side fence unit 52 and the second side fence unit 53 can be positioned with higher accuracy.

Figure 8:
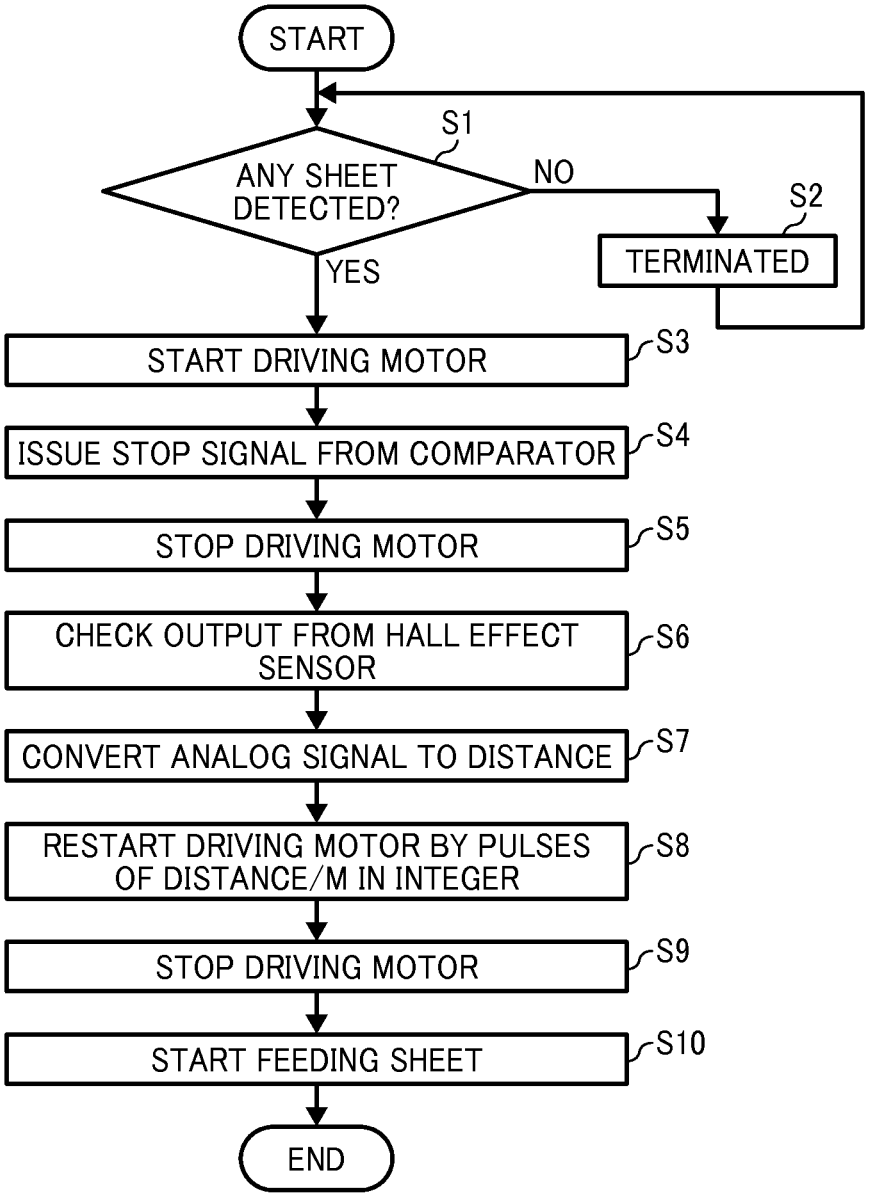
FIG. 8 is a flowchart of a control process of movement of the side fence.

With reference to a flowchart shown in FIG. 8, a description is given of a procedure for controlling the movement of the first side fence unit 52 and the second side fence unit 53 performed by the controller 400 according to Embodiment 1.

In step S1 in the flowchart of FIG. 8, the controller 400 determines based on the result detected by the setting detection sensor 70 regarding whether or not the sheet SH is placed on the sheet setting plate 51. When the sheet SH is not placed on the sheet setting plate 51, the determination result of step S1 is NO, and the process of step S1 terminates the flow in step S2 and returns to step S1.

By contrast, when the controller 400 determines that the sheet SH is placed on the sheet setting plate 51, the determination result of step S1 is YES, and the process proceeds to step S3.

In step S3, the controller 400 starts driving the stepping motor 60, which causes the first side fence unit 52 and the second side fence unit 53 to slide from the respective home positions, which are outermost positions or edges in the width direction of the sheet setting plate 51, to the center in the width direction thereof. At this time, the start of driving the stepping motor 60 triggers detection (and continuous monitoring) of the signal (output) of the Hall effect sensor 54 linearly.

When the output of the Hall effect sensor 54 reaches the threshold, the comparator 65 issues a signal to stop driving the stepping motor 60 in step S4, and then the controller 400 stops driving the stepping motor 60 in step S5. Accordingly, the slide of the first side fence unit 52 and the second side fence unit 53 is stopped moving.

Then, the current output of the Hall effect sensor 54 is checked and confirmed in step S6 and the output (analog signal) is converted by the controller 400 to a distance of movement of the pair of side fences 52 and 53 to be fitted in step S7.

Subsequently, the controller 400 divides the distance of movement of the side fence to be fitted by the distance of the side fence moved when the stepping motor 60 rotates by one pulse so that the controller 400 restarts the stepping motor 60 by the resulting integer number of pulses in step S8.

Accordingly, the stepping motor 60 stops after rotating by the pulses in step S9, the controller 400 settles the state as the sheet feeding can start in step S10, and then the flow of the control process ends.

As described above, in Embodiment 1, when the state in which the contact member 55 contacts the lateral end of the sheet SH is detected, the controller 400 controls the stepping motor 60 to stop the pair of side fence units 52 and 53. With the pair of side fence units 52 and 53 remaining stopped, based on the detection results obtained by the position detector 500 (i.e., the Hall effect sensor 54 and the magnet 56), the controller 400 restarts the stepping motor 60 to move the pair of side fence units 52 and 53 slide in the lateral direction again. With this operation, even when moving the first side fence unit 52 and the second side fence unit 53 automatically, the controller 400 can optimize the respective stop positions of the first side fence unit 52 and the second side fence unit 53 reliably with a relatively simple configuration and control, regardless of types (rigidity, thickness, and so forth) or amounts of the sheet SH.

Figure 9:
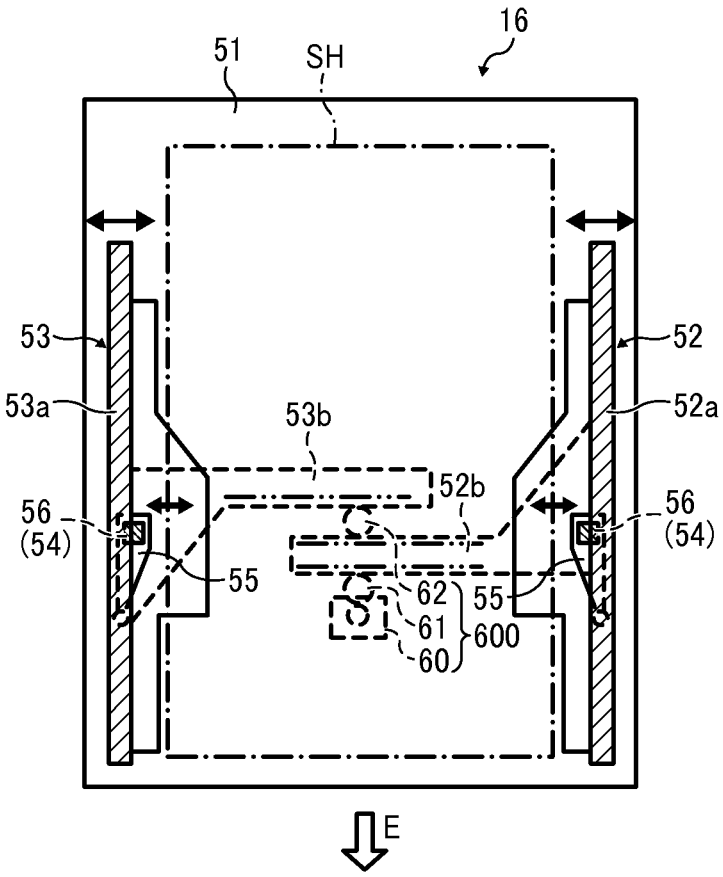
FIG. 9 is a top view illustrating a schematic configuration of a sheet positioning device according to Embodiment 2 of the present invention.

It is to be noted that the contact member 55 is installed on the second side fence unit 53 in Embodiment 1. However, the constant member 55 may be installed on the first side fence unit 52. Further, as an alternative, both the first side fence unit 52 and the second side fence unit 53 may include the respective contact member 55 as illustrated in FIG. 9. In any cases, the same effect as that of Embodiment 1 can be achieved.

[Embodiment 2]

With reference to FIGS. 9-12, descriptions are given of a different configuration of the sheet positioning device according to Embodiment 2 of the present invention.

Figure 10:
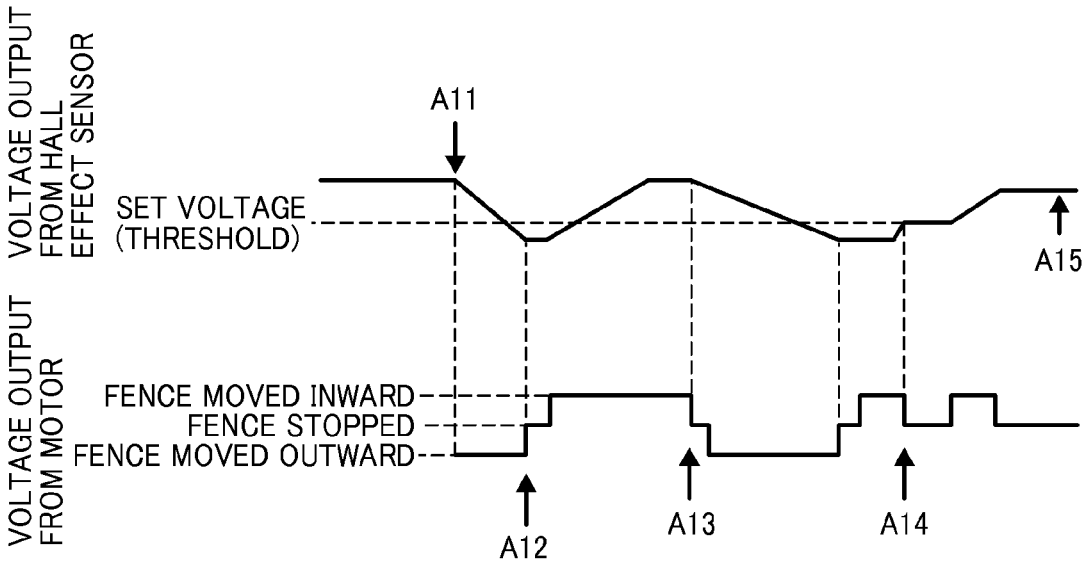
FIG. 10 is a diagram illustrating changes of voltage of the Hall effect sensor in response to movement of the side fence according to Embodiment 2.
Figure 11:
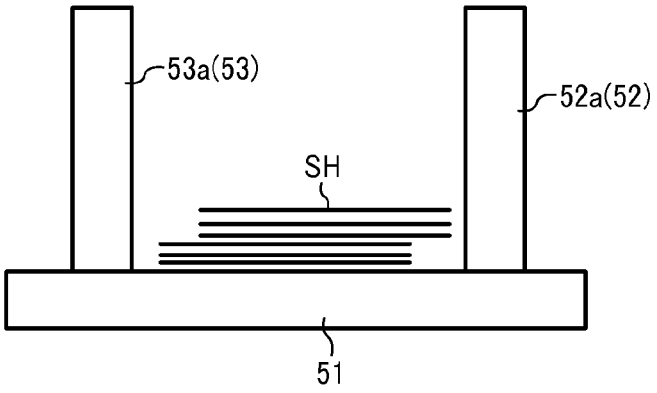
FIG. 11 is a diagram illustrating a state in which a plurality of recording media are displaced in a width direction of the sheet positioning device.
Figure 12:
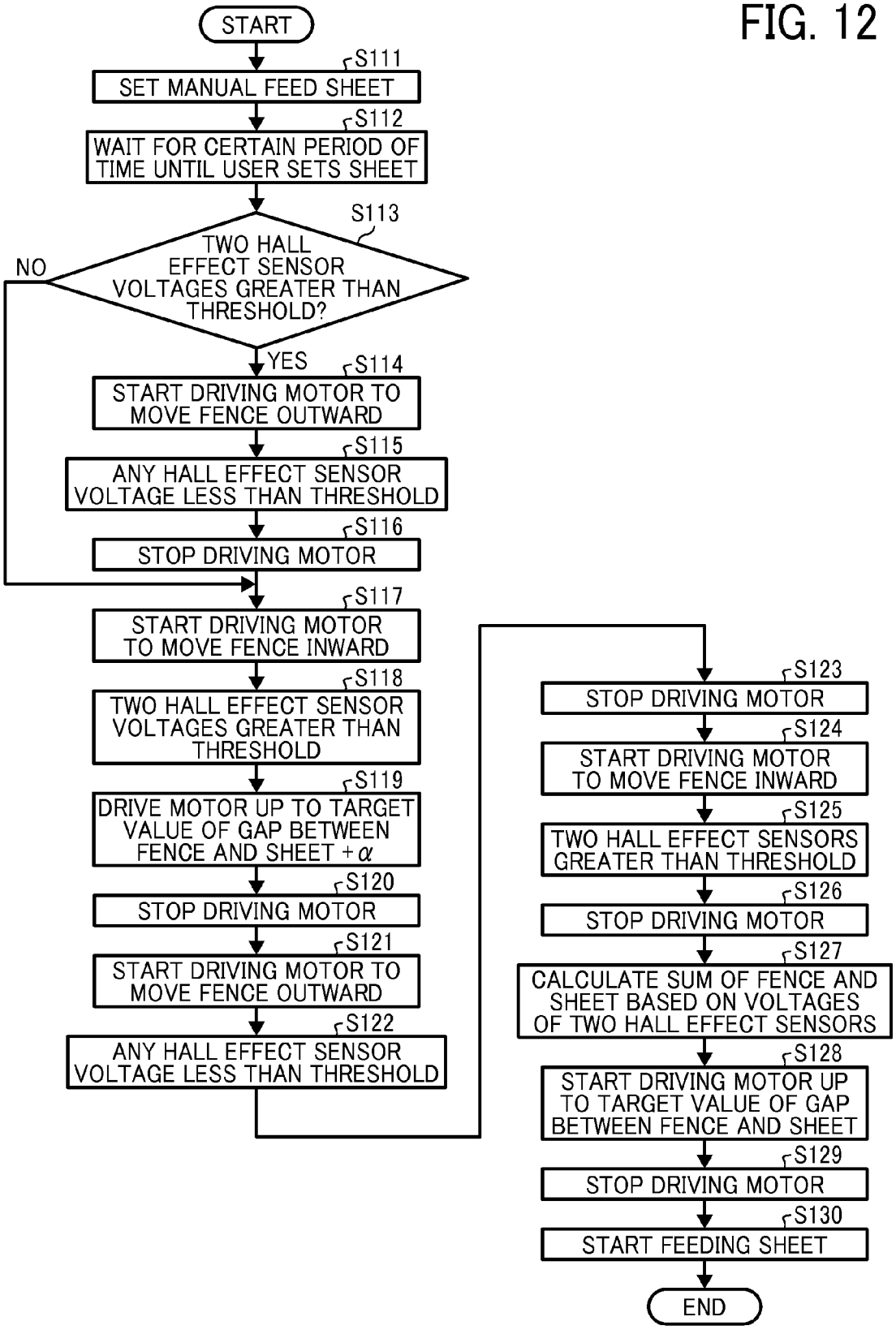
FIG. 12 is a flowchart of a control process of movement of the side fence according to Embodiment 2.

FIG. 9 is a top view illustrating a schematic configuration of the sheet positioning device according to Embodiment 2. FIG. 10 is a diagram illustrating changes of the voltage of the Hall effect sensor 54 and changes of the voltage of the stepping motor 60 in response to lateral movement of the first side fence unit 52 and the second side fence unit 53 from the lateral ends of the sheet setting plate 51 (the sheet SH) toward the center in the lateral direction. FIG. 11 is a diagram illustrating a state in which a plurality of sheets SH placed on the sheet setting plate 51 of the sheet positioning device 16 are displaced or misaligned in the lateral direction. FIG. 12 is a flowchart illustrating the control process of movement of the side fence units 52 and 53 according to Embodiment 2.

The configuration of the sheet positioning device 16 according to Embodiment 2 differs from the configuration of the sheet positioning device 16 according to Embodiment 1 in that the sheet positioning device 16 according to Embodiment 2 further includes executing a control process based on the existence of a gap between the sheet SH placed on the sheet setting plate 51 and the pair of side fence units 52 and 53 and a control process to align the sheet SH when the sheet SH is displaced in the lateral direction on the sheet setting plate 51.

As described above, the configuration of the sheet positioning device 16 according to Embodiment 2 differs from that of the sheet positioning device 16 according to Embodiment 1 insofar as the sheet positioning device 16 according to Embodiment 2 includes two contact members 55, each provided to the first side fence unit 52 and the second side fence unit 53, as illustrated in FIG. 9, whereas the sheet positioning device 16 according to Embodiment 1 includes a single contact member 55 provided to the second side fence unit 53.

In addition to the positioning operation performed in the sheet positioning device 16 according to Embodiment 1, this configuration of the sheet positioning device 16 according to Embodiment 2 provides control based on presence of the gap between the sheet SH placed on the sheet setting plate 51 and the pair of side fence units 52 and 53.

Specifically, when the sheet SH is placed on the sheet setting plate 51 and the contact members 55 contact the lateral ends of the sheet SH, the controller 400 starts the moving mechanism 600 including the stepping motor 60 to separate the pair of side fence units 52 and 53 from each other and then to approach each other to approach the sheet SH in the lateral direction. As the pair of side fence units 52 and 53 move closer to each other, the contact members 55 contact and press the lateral ends of the sheet SH. After the state in which the contact members 55 contact and press the lateral ends of the sheet SH has been detected, the controller 400 stops the moving mechanism 600 to halt movement of the pair of side fence units 52 and 53. While the pair of side fence units 52 and 53 remains stopped, the Hall effect sensor 54 and the magnet 56 of the position detector 500 detect the position of the pair of side fence units 52 and 53. Based on the detection result obtained by the Hall effect sensor 54 and the magnet 56 of the position detector 500, the controller 400 restart the moving mechanism 600 to move the pair of side fence units 52 and 53 to approach each other in the lateral direction again so that the pair of side fence units 52 and 53 are precisely positioned in the lateral direction. That is, when the sheet SH placed on the sheet setting plate 51 is in contact with the contact members 55, the controller 400 moves the first side fence unit 52 and the second side fence unit 53 to increase the space between the first side fence unit 52 and the second side fence unit 53 in a direction to separate them to securely obtain the space between the sheet SH and the first side fence unit 52 and the space between the sheet SH and the second side fence unit 53, and then optimizes the respective stop positions of the first side fence unit 52 and the second side fence unit 53 reliably, which is the same control process performed by the sheet positioning device 16 according to Embodiment 1.

By contrast, when the sheet SH is placed on the sheet setting plate 51 and the contact members 55 do not contact the lateral ends of the sheet SH, the controller 400 starts the moving mechanism 600 including the stepping motor 60 to approach the pair of side fence units 52 and 53 to approach the sheet SH in the lateral direction. As the pair of side fence units 52 and 53 move closer to each other, the contact members 55 contact and press the lateral ends of the sheet SH. After the state in which the contact members 55 contact and press the lateral ends of the sheet SH has been detected, the controller 400 stops the moving mechanism 600 to halt movement of the pair of side fence units 52 and 53. While the pair of side fence units 52 and 53 remains stopped, the Hall effect sensor 54 and the magnet 56 of the position detector 500 detect the position of the pair of side fence units 52 and 53. Based on the detection result obtained by the Hall effect sensor 54 and the magnet 56 of the position detector 500, the controller 400 restarts the moving mechanism 600 to move the pair of side fence units 52 and 53 to approach each other in the lateral direction again based on the detection result obtained by the Hall effect sensor 54 and the magnet 56 of the position detector 500 so that the pair of side fence units 52 and 53 are precisely positioned in the lateral direction. That is, when the sheet SH placed on the sheet setting plate 51 is not in contact with the contact members 55, the controller 400 moves the first side fence unit 52 and the second side fence unit 53 to reduce the space between the first side fence unit 52 and the second side fence unit 53 in a direction to approach to each other, and then optimizes the respective stop positions of the first side fence unit 52 and the second side fence unit 53 reliably, which is the same control process performed by the sheet positioning device 16 according to Embodiment 1.

This control process is performed because the positions of the contact members 55 are the same with respect to the first side fence unit 52 and the second side fence unit 53 in the state in which there is no space between the sheet SH and the first side fence unit 52 and between the sheet SH and the second side fence unit 53 and the state in which the space between the first side fence unit 52 and the second side fence unit 53 are narrower than the width of the sheet SH, is not distinguished by changes in voltage of the Hall effect sensor 54.

By adding the above-described control process, when there is no space between the sheet SH and the first side fence unit 52 and the second side fence unit 53 or when the space between the first side fence unit 52 and the second side fence unit 53 is too narrow, this action can regulate the pair of side fence units 52 and 53 to sandwich both lateral edges of the sheet SH, thereby reducing or avoiding sheet feeding with skew, lateral mispositioning, and wrinkling of the sheet.

Specifically, when placing the sheet SH on the sheet setting plate 51, the first side fence unit 52 and the second side fence unit 53 are moved manually to fit the first side fence unit 52 and the second side fence unit 53 to both lateral ends of the sheet SH, the space between the first side fence unit 52 and the second side fence unit 53 can be too narrow as described above.

Further, it is preferable that this control process is performed a given time period after the setting detection sensor 70 detects that the sheet SH is placed on the sheet setting plate 51. The given time period may be, for example, a time period demanded to move and position the first side fence unit 52 and the second side fence unit 53 manually (action "A11" in FIG. 10).

In addition to the above-described control process, the sheet positioning device 16 according to Embodiment 2 performs another control process to align the sheet SH when the sheet SH is displaced or misaligned in the lateral direction on the sheet setting plate 51, as illustrated in FIG. 11.

Specifically, when the sheet SH is placed on the sheet setting plate 51 and the contact members 55 contact the lateral ends of the sheet SH (action "A11" in FIG. 10), the controller 400 starts driving the moving mechanism 600 including the stepping motor 60 to separate the pair of side fence units 52 and 53 from each other and then approach each other to approach the sheet SH in the lateral direction (action "A12" in FIG. 10). As the pair of side fence units 52 and 53 approach each other, the contact members 55 contact the lateral ends of the sheet SH. Then, the controller 400 causes the moving mechanism 600 to move the pair of side fence units 52 and 53 to further approach each other by a given distance (2 mm or so) (action "A13" in FIG. 10) and then separate the pair of side fence units 52 and 53 from each other to separate from the sheet SH. Then, the controller 400 starts the moving mechanism 600 to move the pair of side fence units 52 and 53 to approach each other toward the sheet SH so that the contact members 55 start to contact the lateral ends of the sheet SH. After the state in which the contact members 55 contact and press the lateral ends of the sheet SH has been detected, the controller 400 stops the moving mechanism 600 to halt movement of the pair of side fence units 52 and 53. While the pair of side fence units 52 and 53 remains stopped, the controller 400 allows the Hall effect sensor 54 and the magnet 56 of the position detector 500 to detect the position of the pair of side fence units 52 and 53. Based on the detection result obtained by the Hall effect sensor 54 and the magnet 56 of the position detector 500, the controller 400 restart the moving mechanism 600 to move the pair of side fence units 52 and 53 to approach each other in the lateral direction again based on the detection result obtained by the Hall effect sensor 54 and the magnet 56 of the position detector 500 (action "A14" in FIG. 10) that the pair of side fence units 52 and 53 are precisely positioned in the lateral direction so that the pair of side fence units 52 and 53 are precisely positioned in the lateral direction. Then, the controller 400 stops the moving mechanism 600 to stop the stepping motor 60 (action "A15" in FIG. 10). That is, when the sheet SH placed on the sheet setting plate 51 is in contact with the contact members 55, the controller 400 moves the first side fence unit 52 and the second side fence unit 53 to increase the space between the first side fence unit 52 and the second side fence unit 53 in a direction to separate them to securely obtain the space between the sheet SH and the first side fence unit 52 and the space between the sheet SH and the second side fence unit 53, and then optimizes the respective stop positions of the first side fence unit 52 and the second side fence unit 53 reliably, which is the same control process performed by the sheet positioning device 16 according to Embodiment 1.

Further, when this control process is performed, the voltage of the Hall effect sensor 54 and the voltage of the stepping motor 60 may change substantially as shown in FIG. 10.

By contrast, when the sheet SH is placed on the sheet setting plate 51 and the contact members 55 do not contact or remain separated from the lateral ends of the sheet SH, the controller 400 starts the moving mechanism 600 including the stepping motor 60 to move the pair of side fence units 52 and 53 to approach each other to approach the sheet SH in the lateral direction. As the pair of side fence units 52 and 53 move closer to each other, the contact members 55 contact the lateral ends of the sheet SH. Then, the controller 400 causes the moving mechanism 600 to move the pair of side fence units 52 and 53 to further approach each other by a given distance (2 mm or so) and then separate the pair of side fence units 52 and 53 from each other to separate from the sheet SH. Then, the controller 400 starts the moving mechanism 600 to move the pair of side fence units 52 and 53 to approach each other toward the sheet SH so that the contact members 55 start to contact the lateral ends of the sheet SH. After the state in which the contact members 55 contact and press the lateral ends of the sheet SH has been detected, the controller 400 stops the moving mechanism 600 to halt movement of the pair of side fence units 52 and 53. While the pair of side fence units 52 and 53 remains stopped, the controller 400 allows the Hall effect sensor 54 and the magnet 56 of the position detector 500 to detect the position of the pair of side fence units 52 and 53. Based on the detection result obtained by the Hall effect sensor 54 and the magnet 56 of the position detector 500, the controller 400 restarts the moving mechanism 600 to move the pair of side fence units 52 and 53 to approach each other in the lateral direction again based on the detection result obtained by the Hall effect sensor 54 and the magnet 56 of the position detector 500 so that the pair of side fence units 52 and 53 are precisely positioned in the lateral direction. That is, when the sheet SH placed on the sheet setting plate 51 is not in contact with the contact members 55, the controller 400 moves the first side fence unit 52 and the second side fence unit 53 to reduce the space therebetween in a direction to approach to each other, then aligns the sheets SH, and optimizes the respective stop positions of the first side fence unit 52 and the second side fence unit 53 reliably, which is the same control process performed by the sheet positioning device 16 according to Embodiment 1.

This control procedure is performed because, if the voltage of the Hall effect sensor 54 is detected while the sheet SH is placed misaligned on the sheet setting plate 51, as illustrated in FIG. 11, the controller 400 may determine that there is no space between the sheet SH and the first side fence unit 52 and between the sheet SH and the second side fence unit 53. To avoid this error, when the controller 400 moves the first side fence unit 52 and the second side fence unit 53 to reduce the space between the first side fence unit 52 and the second side fence unit 53 in a direction to approach to each other, the above-described operations are performed in two steps. That is, the sheet SH is aligned in the first step and the first side fence unit 52 and the second side fence unit 53 are precisely positioned (optimized) in the second step.

To align the sheet SH in the first step, the first side fence unit 52 and the second side fence unit 53 are moved so that the space between the first side fence unit 52 and the second side fence unit 53 is reduced by a given distance that is a minimum excess distance and, in the present embodiment, is set to 2 mm, with respect to the target position of the first side fence unit 52 and the second side fence unit 53 in the lateral direction corresponding to the width size of the sheet SH, and the lateral ends of the misaligned sheets SH are pressed between the first side fence unit 52 and the second side fence unit 53.

When a small number of the sheets SH is set without being misaligned on the sheet setting plate 51, the sheets SH are temporarily buckled very slightly, and therefore the above-described alignment does not adversely affect the precise positioning of the first side fence unit 52 and the second side fence unit 53 and the sheet feeding of the sheets SH performed afterward.

Similarly, when a large number of the sheets SH is set on the sheet setting plate 51 and the sheet stack is aligned, if the stepping motor 60 temporarily gets out of synch or a torque limiter is provided, the above-described control does not drive the stepping motor 60 and just stops the first side fence unit 52 and the second side fence unit 53, and therefore the above-described control does not adversely affect the precise positioning of the first side fence unit 52 and the second side fence unit 53 and the sheet feeding of the sheets SH performed afterward.

Next, a description is given of a control process of movement of the first side fence unit 52 and the second side fence unit 53 performed by the controller 400 according to Embodiment 2 with reference to a flowchart shown in FIG. 12.

In step S111 in the flowchart of FIG. 12, the sheet SH is placed on the sheet setting plate 51, the controller 400 determines based on the result detected by the setting detection sensor 70 that the sheet SH is placed on the sheet setting plate 51, and the process proceeds to step S112.

In step S112, the apparatus remains on standby for a given time period, assuming that the first side fence unit 52 and the second side fence unit 53 are being adjusted manually.

After the given time period has elapsed, the controller 400 determines whether or not the outputs of two Hall effect sensors 54, one provided to the first side fence unit 52 and the other to the second side fence unit 53, are equal to or greater than a set value which is a threshold value, in step S113.

When it is determined that both of the outputs of the Hall effect sensors 54 are smaller than the threshold value, the determination result of step S113 is NO, and the process jumps to step S117.

When it is determined that both of the outputs of the Hall effect sensors 54 are equal to or greater than the threshold value, the determination result of step S113 is YES, and the process proceeds to step S114.

In step S114, it is determined that there is not sufficient space between the sheet SH and the first side fence unit 52 and between the sheet SH and the second side fence unit 53, the controller 400 drives the stepping motor 60 to separate the first side fence unit 52 and the second side fence unit 53 from each other to an open position where the first side fence unit 52 and the second side fence unit 53 are located at the lateral ends of the sheet setting plate 51, with a large space provided therebetween on the sheet setting plate 51.

After step S114, it is detected that at least one output of the Hall effect sensors 54 provided to the first side fence unit 52 and the second side fence unit 53 is smaller than the threshold value in step S115, and the controller 400 stops driving the stepping motor 60 to halt movement of the pair of side fence units 52 and 53 in step S116. With the above-described procedures, sufficient space may be provided between the sheet SH and the first side fence unit 52 and between the sheet SH and the second side fence unit 53.

Then, the controller 400 starts driving the stepping motor 60 to move the first side fence unit 52 and the second side fence unit 53 to approach to each other to a position where the space between the first side fence unit 52 and the second side fence unit 53 narrows in step S117. Then, both of the outputs of the Hall effect sensors 54 become equal to or greater than the threshold value in step S118. At this time, the controller 400 drives the stepping motor 60 to further move the first side fence unit 52 and the second side fence unit 53 to approach each other in the close position by a predetermined distance "α" in step S119, and stops driving the stepping motor 60 to halt movement of the pair of side fence units in step S120.

Specifically, the controller 400 drives the stepping motor 60 to move the first side fence unit 52 and the second side fence unit 53 by the predetermined distance "α" additionally toward the target value of the space between the sheet SH and the first side fence unit 52 and between the sheet SH and the second side fence unit 53. With this action, even if the sheets SH are placed misaligned on the sheet setting plate 51, the alignment of the sheets SH may be conducted.

Thereafter, the controller 400 drives the stepping motor 60 to separate the first side fence unit 52 and the second side fence unit 53 from each other to the open position again, in step S121.

When at least one output of the two Hall effect sensors 54 is smaller than the predetermined threshold in step S122, the controller 400 stops driving the stepping motor 60 to halt movement of the pair of side fence units 52 and 53 in step S123, and then drives the stepping motor 60 to move the first side fence unit 52 and the second side fence unit 53 to approach each other to the close position again in step S124. When both of the outputs of two Hall effect sensors 54 becomes greater than the given threshold at step S125, and stops the stepping motor 60 in step S126.

With the stepping motor 60 remaining stopped, a sum total of the space between sheet SH from the first side fence unit 52 and the second side fence unit 53 is calculated based on two outputs from the Hall effect sensors 54 in step S127. Then, the controller 400 drives the stepping motor 60 again to move the first side fence unit 52 and the second side fence unit 53 toward the respective target positions based on the calculation result in step S128, and stops the stepping motor 60 to stop the pair of side fence units at the target positions in step S129.

By so doing, the respective stop positions of the first side fence unit 52 and the second side fence unit 53 are optimized reliably.

Thus, the sheet positioning device 16 becomes ready to feed the sheet SH in step S130, and the controller 400 completes the operation.

It is to be noted that, when at least one output of the Hall effect sensors 54 provided to the first side fence unit 52 and the second side fence unit 53 is smaller than the threshold value in step S113, it is determined that there is sufficient space between the sheet SH and the first side fence unit 52 and between the sheet SH and the second side fence unit 53, and therefore the controller 400 performs step S117 and the steps thereafter without performing the control process to move the first side fence unit 52 and the second side fence unit 53 in the open direction.

As described above, similar to that of Embodiment 1, in the configuration of the sheet positioning device 12 of Embodiment 2, when the state in which the contact member 55 contacts the lateral end of the sheet SH is detected, the controller 400 controls the stepping motor 60 to stop the pair of side fence units 52 and 53. With the pair of side fence units 52 and 53 remaining stopped, based on the detection results obtained by the position detector 500 (i.e., the Hall effect sensor 54 and the magnet 56), the controller 400 restarts the stepping motor 60 to move the pair of side fence units 52 and 53 slide in the lateral direction again. With this operation, even when moving the first side fence unit 52 and the second side fence unit 53 automatically, the controller 400 can optimize the respective stop positions of the first side fence unit 52 and the second side fence unit 53 reliably with a relatively simple configuration and control, regardless of types (rigidity, thickness, and so forth) or amounts of the sheet SH.

Further, the sheet positioning device 16 according to Embodiments 1 and 2 is provided to the image forming apparatus 1 producing black-and-white or monochrome images. However, it is not limited thereto, and the sheet positioning device 16 according to Embodiments 1 and 2 can be provided to a color image forming apparatus to achieve the same effect as the monochrome image forming apparatus 1.

Furthermore, the sheet positioning device 16 according to Embodiments 1 and 2 is provided to the image forming apparatus 1 employing an electrophotographic technology. However, it is not limited thereto, and the sheet positioning device 16 according to Embodiments 1 and 2 can be provided to other image forming apparatuses such as inkjet image forming apparatuses to achieve the same effect as the electrophotographic image forming apparatus 1.

Further, as described above, the techniques described in Embodiments 1 and 2 can be applied to the configurations of the sheet positioning device 16 of the image forming apparatus 1 but not limited thereto. For example, the technique described in Embodiments 1 and 2 can also be applied to the sheet cassettes 12 through 15 and to the original document feeder 10 (i.e., the automatic original document feeder). The sheet cassettes 12 through 15 and the original document feeder 10, each employing the same technique as the sheet positioning device 16, can achieve the same effect.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. An image forming apparatus comprising:

an image forming device to form an image on a surface of a sheet of recording media; and a sheet positioning device to position the sheet before feeding the sheet to the image forming device, the sheet positioning device including:

a sheet setting plate to accommodate the sheet of recording media set thereon;

a pair of side fence units disposed facing each other along opposite sides of the sheet setting plate and configured to move in the lateral direction perpendicular to a conveyance direction of the sheet on the sheet setting plate;

a moving mechanism disposed on a back side of the sheet setting plate and configured to move the pair of side fence units in the lateral direction;

a contact member disposed to at least one of the pair of side fence units, protruding from a surface of the one of the pair of side fence units toward a center thereof in the lateral direction and configured to contact a lateral end of the sheet and press the sheet in the lateral direction;

a position detector to detect the position of the contact member in the lateral direction on the sheet setting plate; and a controller configured to control the moving mechanism to move and stop the pair of side fence units in the lateral direction, the controller configured to:

start the moving mechanism to move the pair of side fence units in the lateral direction for approximate positioning when the sheet is placed on the sheet setting plate;

stop the moving mechanism to halt movement of the pair of side fence units after the contact member has contacted and pressed the lateral end of the sheet;

allow the position detector to detect the position of the pair of side fence units while the pair of side fences remains stopped; and restart the moving mechanism to move the pair of side fence units in the lateral direction based on detection results obtained by the position detector for precise positioning of the pair of side fence units.

2. The image forming apparatus according to claim 1, wherein, when the sheet is placed on the sheet setting plate and the contact member contacts the lateral end of the sheet, the controller:

starts the moving mechanism to separate the pair of side fence units from each other and then to approach each other to approach the sheet in the lateral direction;

stops the moving mechanism to halt movement of the pair of side fence units after the contact member has contacted and pressed the lateral end of the sheet;

allows the position detector to detect the position of the pair of side fence units while the pair of side fences remains stopped; and restarts the moving mechanism to move the pair of side fence units to approach each other in the lateral direction again based on the detection result obtained by the position detector for the precise positioning of the pair of side fence units in the lateral direction, and wherein, when the sheet is placed on the sheet setting plate and the contact member is not in contact with the lateral end of the sheet, the controller:

starts the moving mechanism to approach the pair of side fence units each other to approach the sheet in the lateral direction;

stops the moving mechanism to halt movement of the pair of side fence units after the contact member has contacted and pressed the lateral end of the sheet;

allows the position detector to detect the position of the pair of side fence units while the pair of side fences remains stopped; and restarts the moving mechanism to move the pair of side fence units to approach each other in the lateral direction again based on the detection result obtained by the position detector for the precise positioning of the pair of side fence units in the lateral direction.

3. The image forming apparatus according to claim 1, wherein, when the sheet is placed on the sheet setting plate and the contact member contacts the lateral end of the sheet, the controller:

starts the moving mechanism to separate the pair of side fence units from each other and then approach each other to approach the sheet in the lateral direction;

causes the moving mechanism to move the pair of side fence units to further approach each other by a given distance after the contact member contacts the lateral end of the sheet and then separate from each other;

starts the moving mechanism to move the pair of side fence units to approach each other;

stops the moving mechanism to halt movement of the pair of side fence units after the contact member has contacted and pressed the lateral end of the sheet;

allows the position detector to detect the position of the pair of side fence units while the pair of side fence units remains stopped; and restarts the moving mechanism to move the pair of side fence units to approach each other in the lateral direction again based on the detection result obtained by the position detector for the precise positioning of the pair of side fence units in the lateral direction, and wherein, when the sheet is placed on the sheet setting plate and the contact member remains separated from the lateral end of the sheet, the controller:

starts the moving mechanism to move the pair of side fence units to approach each other to approach the sheet in the lateral direction;

causes the moving mechanism to move the pair of side fence units to further approach each other by a given distance after the contact member contacts the lateral end of the sheet and then separate from each other;

starts the moving mechanism to move the pair of side fence units to approach each other;

stops the moving mechanism to halt movement of the pair of side fence units after the contact member has contacted and pressed the lateral end of the sheet;

allows the position detector to detect the position of the pair of side fence units while the pair of side fence units remains stopped; and restarts the moving mechanism to move the pair of side fence units to approach each other in the lateral direction again based on the detection result obtained by the position detector for the precise positioning of the pair of side fence units in the lateral direction.

4. The image forming apparatus according to claim 1, wherein the position detector comprises:

a Hall effect sensor to move in the lateral direction together with the at least one of the pair of side fence units; and a magnet disposed facing the Hall effect sensor to move along with the contact member in the lateral direction, wherein, based on an output of the Hall effect sensor, the position detector detects that the contact member is in contact with the lateral end of the sheet and an amount of change of movement of the contact member in the lateral direction.

5. The image forming apparatus according to claim 4, wherein the position detector comprises a comparator to output a signal to stop moving the pair of side fence units when the output of the Hall effect sensor reaches a predetermined threshold value indicating that the contact member is in contact with the lateral end of the sheet.

6. The image forming apparatus according to claim 4, wherein the position detector is calibrated in a manufacturing process with at least the moving mechanism, the pair of side fence units, and the contact member.

7. The image forming apparatus according to claim 1, wherein the moving mechanism comprises a stepping motor, and wherein the controller starts, stops, and restarts the moving mechanism to move and stop the pair of side fence units based on pulse control of the stepping motor.

8. A sheet positioning device comprising:

a sheet setting plate to accommodate a sheet of recording media set thereon;

a pair of side fence units disposed facing each other along opposite of the sheet setting plate and configured to move in a lateral direction perpendicular to a conveyance direction of the sheet on the platen;

a moving mechanism disposed on a back side of the sheet setting plate, and configured to move the pair of side fence units in the lateral direction;

a contact member disposed to at least one of the pair of side fence units, protruding from a surface of the one of the pair of side fence units toward a center in the lateral direction and configured to contact a lateral end of the sheet and press the sheet in the lateral direction;

a position detector to detect the position of the contact member in the lateral direction on the sheet setting plate; and a controller configured to control the moving mechanism to move and stop the pair of side fence units in the lateral direction, the controller configured to:

start the moving mechanism to move the pair of side fence units in the lateral direction for approximate positioning when the sheet is placed on the sheet setting plate;

stop the moving mechanism to halt movement of the pair of side fence units after the contact member has contacted and pressed the lateral end of the sheet;

allow the position detector to detect the position of the pair of side fence units while the pair of side fences remains stopped; and restart the moving mechanism to move the pair of side fence units in the lateral direction based on detection results obtained by the position detector for precise positioning of the pair of side fence units.

9. The sheet positioning device according to claim 8, wherein, when the sheet is placed on the sheet setting plate and the contact member contacts the lateral end of the sheet, the controller:

starts the moving mechanism to separate the pair of side fence units from each other and then to approach each other to approach the sheet in the lateral direction;

stops the moving mechanism to halt movement of the pair of side fence units after the contact member has contacted and pressed the lateral end of the sheet;

allows the position detector to detect the position of the pair of side fence units while the pair of side fences remains stopped; and restarts the moving mechanism to move the pair of side fence units to approach each other in the lateral direction again based on the detection result obtained by the position detector for the precise positioning of the pair of side fence units in the lateral direction, and wherein, when the sheet is placed on the sheet setting plate and the contact member is not in contact with the lateral end of the sheet, the controller:

starts the moving mechanism to approach the pair of side fence units each other to approach the sheet in the lateral direction;

stops the moving mechanism to halt movement of the pair of side fence units after the contact member has contacted and pressed the lateral end of the sheet;

allows the position detector to detect the position of the pair of side fence units while the pair of side fences remains stopped; and restarts the moving mechanism to move the pair of side fence units to approach each other in the lateral direction again based on the detection result obtained by the position detector for the precise positioning of the pair of side fence units in the lateral direction.

10. The sheet positioning device according to claim 8, wherein, when the sheet is placed on the sheet setting plate and the contact member contacts the lateral end of the sheet, the controller:

starts the moving mechanism to separate the pair of side fence units from each other and then approach each other to approach the sheet in the lateral direction;

causes the moving mechanism to move the pair of side fence units to further approach each other by a given distance after the contact member contacts the lateral end of the sheet and then separate from each other;

starts the moving mechanism to move the pair of side fence units to approach each other;

stops the moving mechanism to halt movement of the pair of side fence units after the contact member has contacted and pressed the lateral end of the sheet;

allows the position detector to detect the position of the pair of side fence units while the pair of side fence units remains stopped; and restarts the moving mechanism to move the pair of side fence units to approach each other in the lateral direction again based on the detection result obtained by the position detector for the precise positioning of the pair of side fence units in the lateral direction, and wherein, when the sheet is placed on the sheet setting plate and the contact member remains separated from the lateral end of the sheet, the controller:

starts the moving mechanism to move the pair of side fence units to approach each other to approach the sheet in the lateral direction;

causes the moving mechanism to move the pair of side fence units to further approach each other by a given distance after the contact member contacts the lateral end of the sheet and then separate from each other;

starts the moving mechanism to move the pair of side fence units to approach each other;

stops the moving mechanism to halt movement of the pair of side fence units after the contact member has contacted and pressed the lateral end of the sheet;

allows the position detector to detect the position of the pair of side fence units while the pair of side fence units remains stopped; and restarts the moving mechanism to move the pair of side fence units to approach each other in the lateral direction again based on the detection result obtained by the position detector for the precise positioning of the pair of side fence units in the lateral direction.

11. The sheet positioning device according to claim 8, wherein the position detector comprises:

a Hall effect sensor to move in the lateral direction together with the at least one of the pair of side fence unit; and a magnet disposed facing the Hall effect sensor to move along with the contact member in the lateral direction, wherein, based on an output of the Hall effect sensor, the position detector detects that the contact member is in contact with the lateral end of the sheet and an amount of change of movement of the contact member in the lateral direction.

12. The sheet positioning device according to claim 11, wherein the position detector comprises a comparator to output a signal to stop moving the pair of side fence units when the output of the Hall effect sensor reaches a predetermined threshold value indicating that the contact member is in contact with the lateral end of the sheet.

13. The sheet positioning device according to claim 11, wherein the position detector is calibrated in a manufacturing process with at least the moving mechanism, the pair of side fence units, and the contact member.

14. The sheet positioning device according to claim 8, wherein the moving mechanism comprises a stepping motor, and wherein the controller starts, stops, and restarts the moving mechanism to move and stop the pair of side fence units based on pulse control of the stepping motor.

15. A method of positioning a sheet on a sheet setting plate, comprising:

starting a moving mechanism to move a pair of side fence units disposed facing each other along opposite sides of the sheet setting plate in a lateral direction when the sheet is placed on the sheet setting plate for approximate positioning;

stopping the moving mechanism to halt movement of the pair of side fence units after a contact member disposed to at least one of the pair of side fence units has contacted and pressed a lateral end of the sheet;

allowing a position detector to detect the position of the pair of side fence units while the pair of side fences remains stopped; and restarting the moving mechanism to move the pair of side fence units in the lateral direction based on detection results obtained by the position detector for precise positioning of the pair of side fence units.

16. The method of positioning according to claim 15, further comprising:

starting the moving mechanism to move the pair of side fence units to approach each other based on a detection result obtained by a setting detection sensor;

stopping the moving mechanism to halt movement of the pair of side fence units based on a signal issued by a comparator;

checking a current output of a Hall effect sensor;

converting the output to a distance of movement of the pair of side fence units;

rotating the moving mechanism by a given pulse; and stopping the moving mechanism after rotating the moving mechanism by the given pulse.

17. The method of positioning according to claim 15, further comprising:

when the sheet is placed on the sheet setting plate and the contact member contacts the lateral end of the sheet, starting the moving mechanism to separate the pair of side fence units from each other and then to approach each other to approach the sheet in the lateral direction;

stopping the moving mechanism to halt movement of the pair of side fence units after the contact member has contacted and pressed the lateral end of the sheet;

allowing the position detector to detect the position of the pair of side fence units while the pair of side fences remains stopped; and restarting the moving mechanism to move the pair of side fence units to approach each other in the lateral direction again based on the detection result obtained by the position detector for the precise positioning of the pair of side fence units in the lateral direction, and when the sheet is placed on the sheet setting plate and the contact member is not in contact with the lateral end of the sheet, starting the moving mechanism to approach the pair of side fence units each other to approach the sheet in the lateral direction;

stopping the moving mechanism to halt movement of the pair of side fence units after the contact member has contacted and pressed the lateral end of the sheet;

allowing the position detector to detect the position of the pair of side fence units while the pair of side fences remains stopped; and restarting the moving mechanism to move the pair of side fence units to approach each other in the lateral direction again based on the detection result obtained by the position detector for the precise positioning of the pair of side fence units in the lateral direction.

18. The method of positioning according to claim 15, further comprising:

when the sheet is placed on the sheet setting plate and the contact member contacts the lateral end of the sheet, starting the moving mechanism to separate the pair of side fence units from each other and then approach each other to approach the sheet in the lateral direction;

causing the moving mechanism to move the pair of side fence units to further approach each other by a given distance even after the contact member contacts the lateral end of the sheet and then separate from each other;

starting the moving mechanism to move the pair of side fence units to approach each other;

stopping the moving mechanism to halt movement of the pair of side fence units after the contact member has contacted and pressed the lateral end of the sheet;

allowing the position detector to detect the position of the pair of side fence units while the pair of side fences remains stopped; and restarting the moving mechanism to move the pair of side fence units to approach each other in the lateral direction again based on the detection result obtained by the position detector for the precise positioning of the pair of side fence units in the lateral direction, and when the sheet is placed on the sheet setting plate and the contact member remains separated from the lateral end of the sheet, starting the moving mechanism to move the pair of side fence units to approach each other to approach the sheet in the lateral direction;

causing the moving mechanism to move the pair of side fence units to further approach each other by a given distance after the contact member contacts the lateral end of the sheet and then separate from each other;

starting the moving mechanism to move the pair of side fence units to approach each other;

stopping the moving mechanism to halt movement of the pair of side fence units after the contact member has contacted and pressed the lateral end of the sheet;

allowing the position detector to detect the position of the pair of side fence units while the pair of side fences remains stopped; and restarting the moving mechanism to move the pair of side fence units to approach each other in the lateral direction again based on the detection result obtained by the position detector for the precise positioning of the pair of side fence units in the lateral direction.

19. The method of positioning according to claim 15, further comprising:

determining whether or not outputs of two Hall effect sensors are equal to or greater than a threshold value;

separating the pair of side fence units from each other;

halting movement of the pair of side fence units when at least one output of the Hall effect sensors is smaller than the threshold value;

moving the pair of side fence units to approach each other;

further moving the pair of side fence units to approach each other by a predetermined distance;

halting movement of the pair of side fence units when both of the outputs of the Hall effect sensors become equal to or greater than the threshold value;

separating the pair of side fence units from each other;

stopping the pair of side fence units when at least one output of the Hall effect sensors is smaller than the predetermined threshold;

moving the pair of side fence units to approach each other;

stopping the pair of side fence units when both outputs of the Hall effect sensors are greater than the predetermined threshold;

calculating a sum total of space between the sheet from the pair of side fence units based on the outputs from the Hall effect sensor while the pair of side fence units remains stopped;

moving the pair of side fence units toward respective target positions based on the calculation result; and stopping the pair of side fence units at the target positions.

* * * * *